US006093052A

United States Patent [19]

Wang

[11] Patent Number: 6,093,052

[45] Date of Patent: Jul. 25, 2000

[54] ELECTRIC WIRE CONNECTOR AND ELECTRIC WIRE

[76] Inventor: Jen-Ching Wang, No. 27, Lane 4, Lane 446, Fu Hsin Rd., Shu Lin Chen, Taipei County, Taiwan

[21] Appl. No.: 09/342,141

[22] Filed: Jun. 29, 1999

[51] Int. Cl.[7] ..... H01R 4/24

[52] U.S. Cl. ..... 439/441; 439/439

[58] Field of Search ..... 439/441, 436, 439/437, 438, 439, 440, 654

[56] References Cited

U.S. PATENT DOCUMENTS

| | | | |
|---|---|---|---|
| 4,084,876 | 4/1978 | Dinger | 439/439 |
| 4,768,976 | 9/1988 | Gelati | 439/441 |

FOREIGN PATENT DOCUMENTS

| | | | |
|---|---|---|---|
| 0838778 | 7/1952 | Germany | 439/441 |
| 1240573 | 5/1967 | Germany | 439/441 |
| 0726317 | 3/1955 | United Kingdom | 439/439 |
| 1434965 | 5/1976 | United Kingdom | 439/439 |

*Primary Examiner*—Gary F. Paumen
*Assistant Examiner*—Tho D. Ta
*Attorney, Agent, or Firm*—Varndell & Varndell, PLLC

[57] ABSTRACT

An electric wire connector and electric wire arrangement, which includes a cylindrical casing, the cylindrical casing having an axially extended wire hole, first and second longitudinal positioning grooves disposed in the wire hole at bottom and top sides and axially extended to one end thereof, and two locating grooves respectively and axially extended to two opposite ends thereof in reversed directions, a metal contact plate mounted in the second longitudinal positioning groove inside the casing, two electric wires respectively inserted into the wire hole from two opposite ends of the casing, and a metal retaining plate mounted in the first longitudinal positioning groove inside casing to hold the conductor means of the electric wires in close contact with the metal contact plate, the metal retaining plate having a flat, elongated base portion mounted in the first longitudinal positioning groove, two retaining portions extended upwardly obliquely from two opposite ends of the base portion and respectively pressed on the conductor means of the electric wire against the metal contact plate, a hooksed portion hooked on a stop edge at one end of the locating groove, and a shoulder portion connected between one end of the base portion and one of the retaining portions and stopped at a top edge at one end of the first longitudinal positioning groove.

3 Claims, 6 Drawing Sheets

ELECTRIC WIRE CONNECTOR AND ELECTRIC WIRE

BACKGROUND AND SUMMARY OF THE INVENTION

The present invention relates to an electric wire connector and electric wire arrangement, in which the conductor of each of two electric wires which are inserted into an axially extended wire hole in a cylindrical casing from two opposite ends is immediately and respectively held down by a metal retaining plate in the casing, and maintained in contact with a metal contact in the casing.

When arranging electric wires in a room, two electric wires may have to be electrically connected. When connecting two electric wires, the insulator layer at each electric wire is propery cut off, enabling the conductor of each electric wire to be exposed to the outside, so that the conductor of one electric wire can be fastened to the conductor of the other. After connection of the conductors of the two electric wires, an insulative tape is used to wrap the connecting area between the electric wires. This procedure is complicated. Further, if the insulative tape is softened due to hot weather, the electric wires may be disconnected from each other when stretched.

The present invention has been accomplished under the circumstances in view. According to one aspect of the present invention, the electric wire connector and electric wire arrangement comprises a cylindrical casing, the cylindrical casing having an axially extended wire hole,, and first and second longitudinal positioning grooves disposed in the wire hole at bottom and top sides an axially extended to one end thereof, two electric wires respectively inserted into the wire hole from two opposite ends of the casing, and a metal retaining plate mounted in the first longitudinal positioning groove inside casing to hold the conductor means of the electric wires in close contact with the metal contact plate, the metal retaining plate having a flat, elongated base portion mounted in the first longitudinal positioning groove, and two retaining portions extended upwardly obliquely from two opposite ends of the base portion and respectively pressed on the conductor means of the electric wire against the metal contact plate. According to another aspect of the present invention, the casing further comprises a first stop edge at one end of the first longitudinal positioning groove which stops one end of the metal retaining plate, a second stop edge at one end of the second longitudinal positioning groove which stops one end of said metal contact plate, two locating grooves respectively and axially extended to the distal ends thereof in reversed directions and disposed in communication with the wire hole through the first longitudinal positioning groove, the locating grooves each having an inner end terminating in a respective stop edge, the metal retaining plate further comprises a hooked portion downwardly raised from the base portion and hooked on the stop edge at one end of one of the locating grooves, and two shoulder portions respectively connected between the base portion and the retaining portions, one of the shoulder portions being stopped at the first stop edge at one end of the first longitudinal positioning groove. According to still another aspect of the present invention, the metal contact plate comprises two elongated dents of smoothly arched cross section longitudinally extended in reversed directions to two distal ends thereof, which receive the conductor means of the first electric wire and the second electric wire, and a stop strip portion downwardly raised from a bottom side wall thereof between the elongated dents, which separates the conductor means of the first electric wire from the conductor means of the second electric wire. According to still another aspect of the present invention, the insulator layer of the first electric wire and the insulator layer of the second electric wire each have a part respectively engaged into the two opposite ends of the wire hole in the casing. In an alternate form of the present invention, the casing is made having multiple wire holes for holding multiple pairs of electric wires, each wire hole having installed therein one metal contact plate and one metal retaining plate for holding the conductors of the respective pair of electric wires in an electrically connected position.

DETAILED DESCRIPTION OF THE PREFERRED EMBODIMENT

Figure 1:
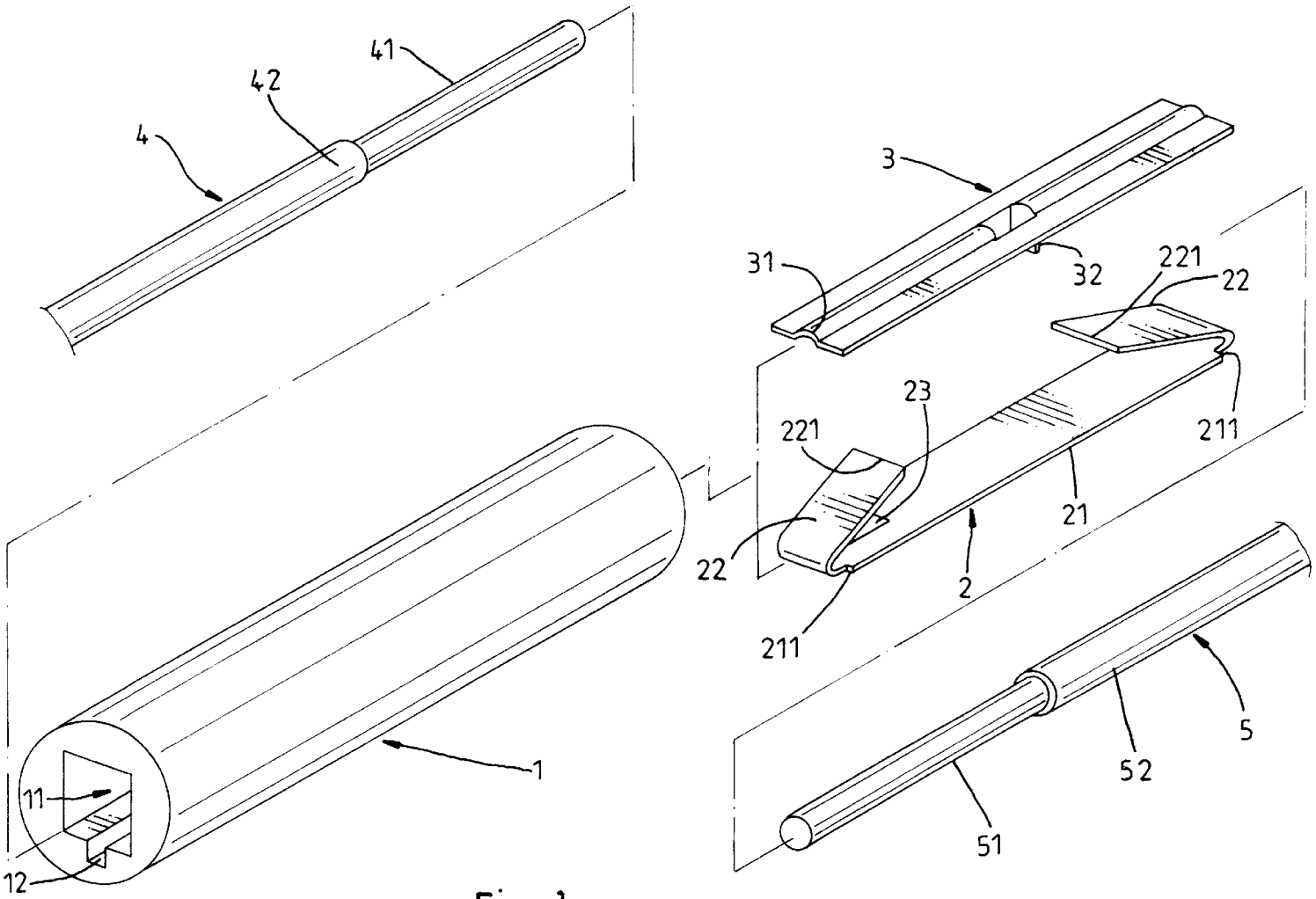
FIG. 1 is an exploded view of the present invention.
Figure 2:
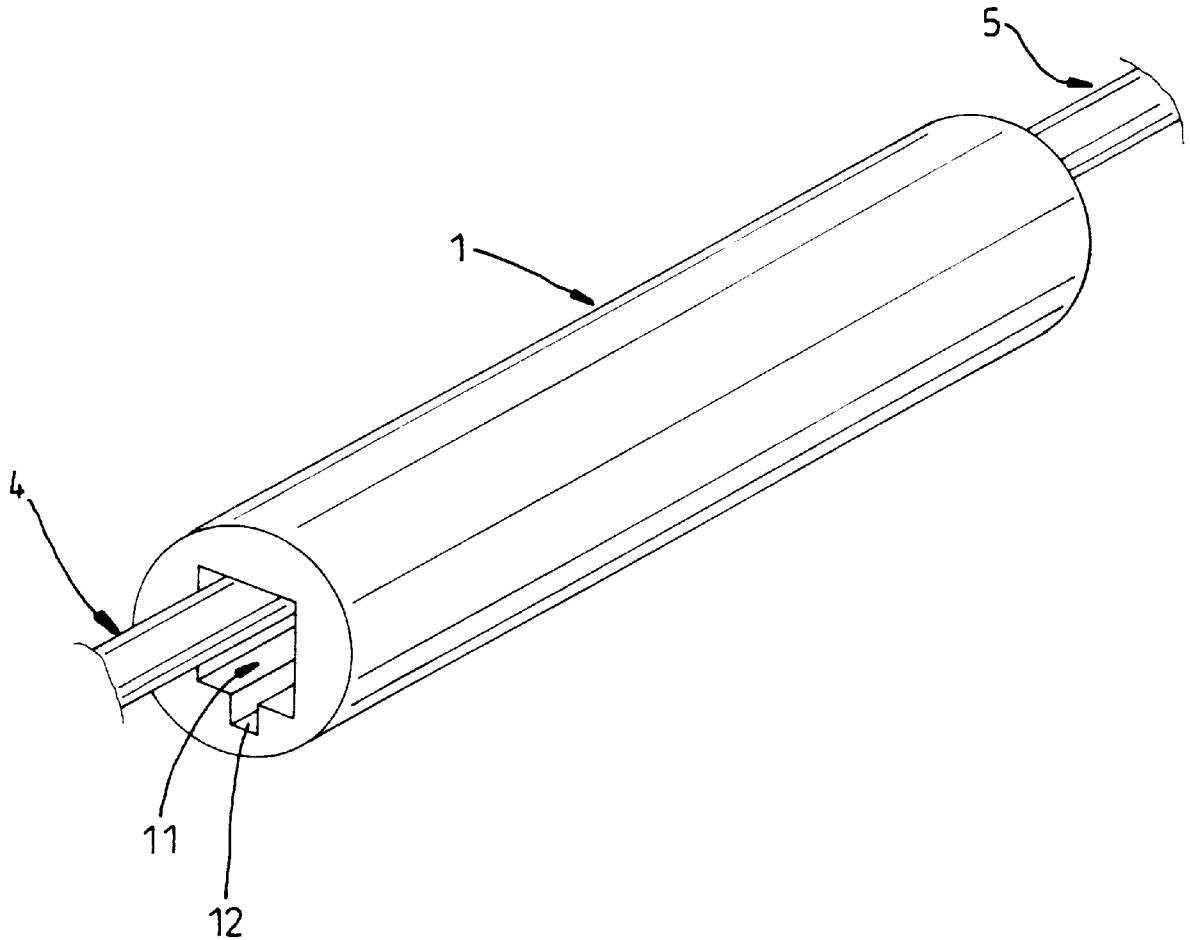
FIG. 2 is an installed view of the present invention.
Figure 3:
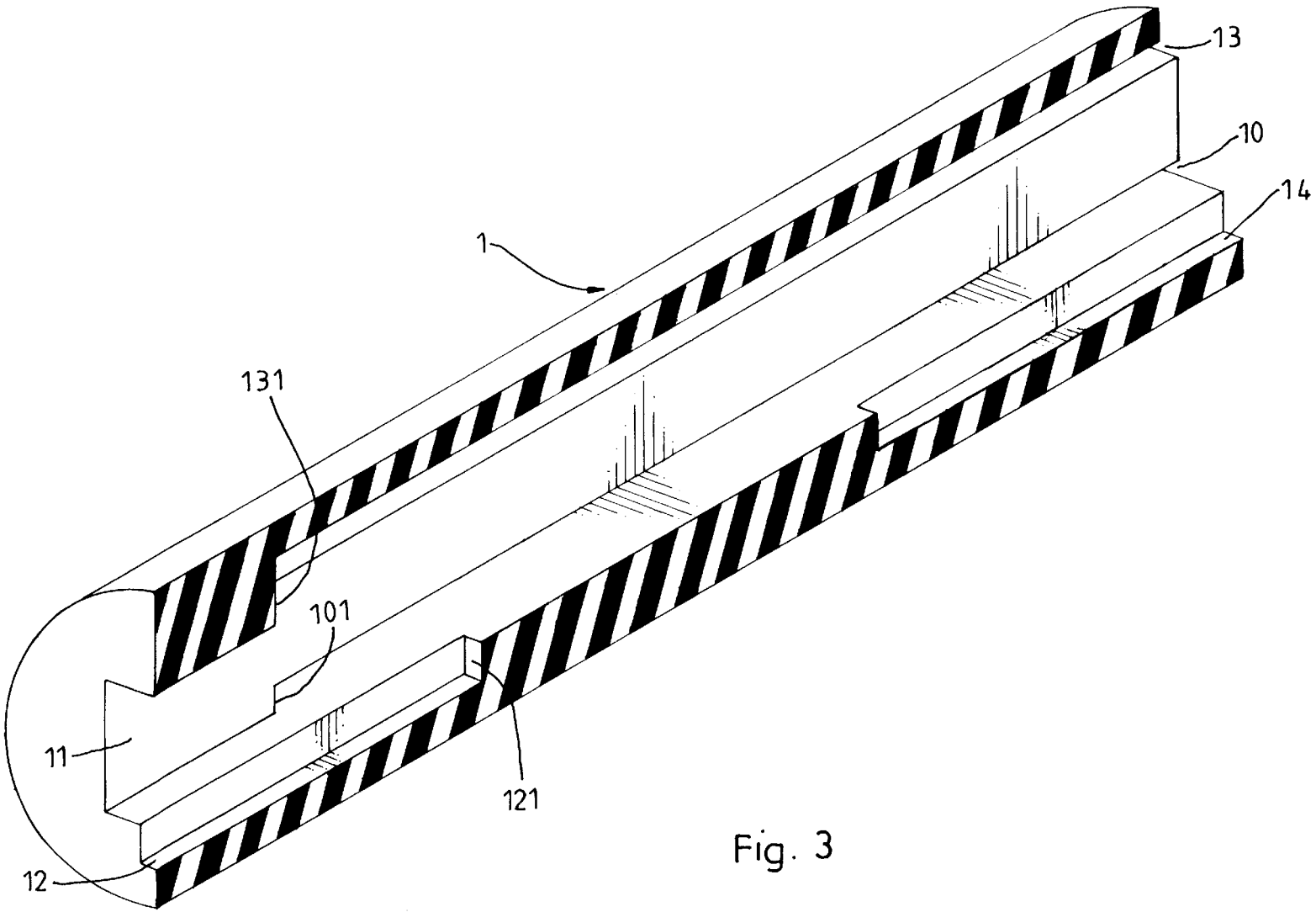
FIG. 3 is a cutaway in an enlarged scale of the cylindrical casing according to the present invention.
Figure 5:
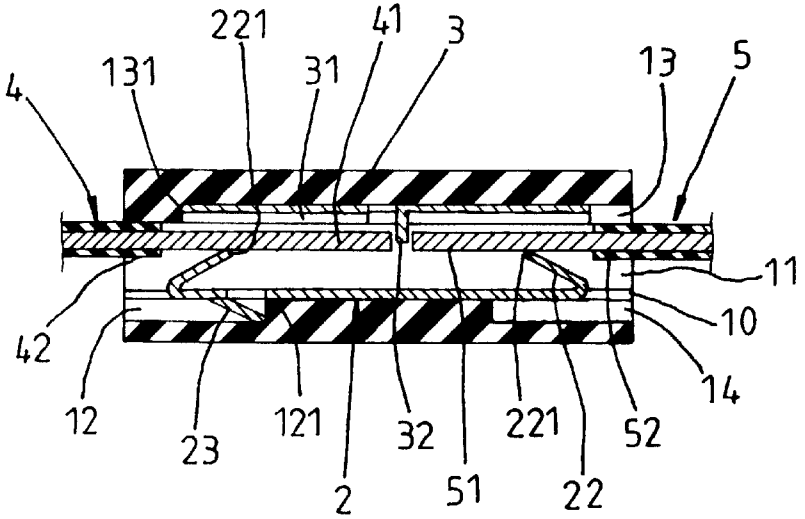
FIG. 5 is similar to FIG. 4 but showing the electric wires installed.
Figure 4:
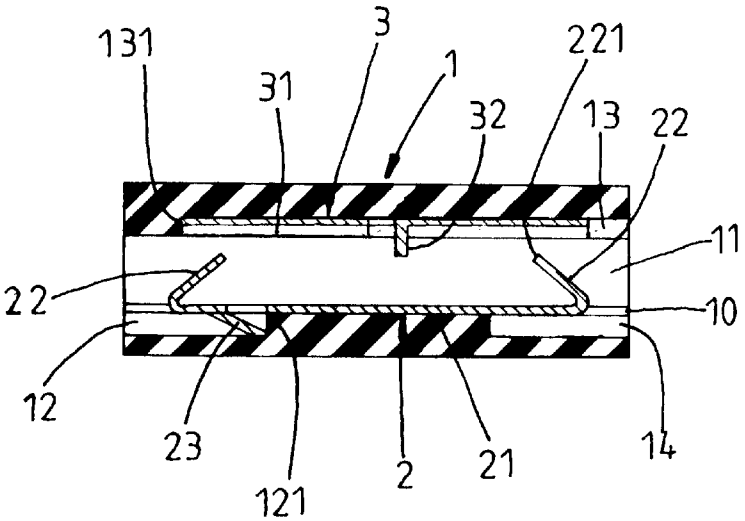
FIG. 4 is a longitudinal view in section in a reduced scale of the present invention, showing the metal contact plate and the metal retaining plate installed in the cylindrical casing (before the installation of the electric wires).
Figure 7:
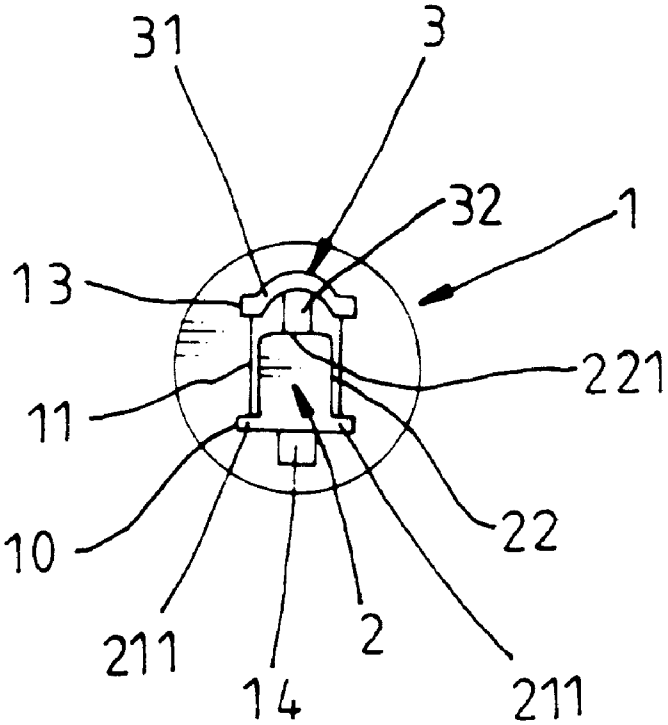
FIG. 7 is a front plain view of FIG. 5.
Figure 6:
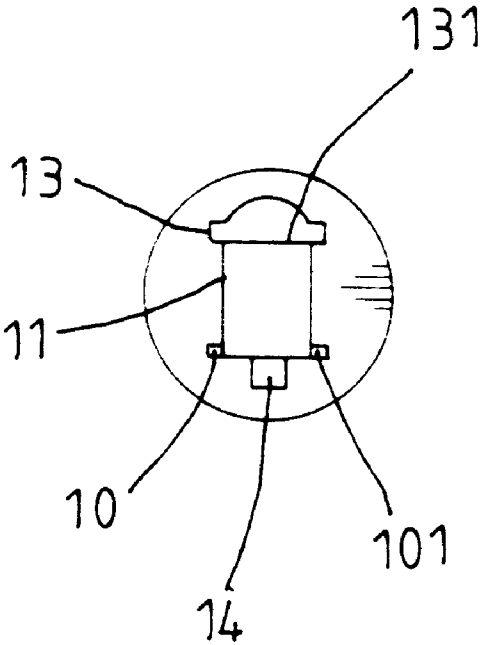
FIG. 6 is a front plain view of FIG. 4.

Referring to FIGS. 1 through 7, an electric wire connector is provided for connecting two electric wires 4 and 5 together, enabling the conductor 41 of the first electric wire 4 to be electrically connected to the conductor 51 of the second electric wire 5. The electric wire connector is comprised of a cylindircal casing 1, a metal retaining plate 2, and a metal contact plate 3.

The cylindrical casing 1 comprises an axially extended wire hole 11, a first longitudinal positioning groove 10 and a second longitudinal positioning groove 13 disposed in the wire hole 11 at bottom and top sides and axially extended to one end of the cylindircal casing 1 for the positioning of the metal retaining plate 2 and the metal contact plate 3 respectively, two locating grooves, namely, the first locating groove 12 and the second locating groove 14 respectively and axially extended to the distal ends of the cylindrical casing 1 in reversed directions and disposed in communication with the wire hole 11 through the first longitudinal positioning groove 10, a first stop edge 101 at one end of the first longitudinal positioning groove 10 inside the wire hole 11, and a second stop edge 131 at one end of the second longitudinal positioning groove 13 inside the wire hole 11. The locating grooves 12 and 14 each have an inner end terminating in a respective stop edge 121.

The metal retaining plate 2 is inserted into the first longitudinal positioning groove 10 in the cylindrical casing 1, comprising a flat, elongated base portion 21, two retaining portions 22 extended upwardly obliquely from two distal ends of the base portion 21 toward each other and terminating in a respective end edge 221. After insertion of the electric wires 5 into the wire hole 11 from two distal ends of at the cylindrical casing 1, the end edge 221 of each of the retaining portions 22 of the metal retaining plate 2 is respectively pressed on the conductors 41 and 51 of the electric wires 4 and 5 against the metal contact plate 3, thereby causing the electric wires 4 and 5 to be firmly and electrically connected to the metal contact plate 3. The metal retaining plate 2 further comprises a hooked portion 23 downwardly raised from the base portion 21 at one end, and two shoulder portions 211 respectively connected between the base portion 21 and the retaining portions 22. After insertion of the metal retaining plate 2 into the first longitudinal positioning groove 10 in the cylindrical casing 1, the hooked portion 23 is hooked on the end edge 121 at one end of the first locating groove 12, and one shoulder portion 211 of the metal retaining plate is stopped at the first stop edge 101 at the inner end of the first longitudinal positioning groove 10 inside the cylindrical casing 1 (see FIGS. 3 and 4), and therefore the metal retaining plate 2 is firmly retained in place, and prohibited from axial movement relative to the cylindrical casing 1.

The metal contact plate 3 is inserted into the second longitudinal positioning groove 13 and stopped at the second stop edge 131 inside the cylindrical casing 1, comprising two elongated dents 31 of smoothly arched cross section longitudinally extended in revsersed directions to two distal ends thereof for holding the conductors 41 and 51 of the electric wires 4 and 5 respectively, and a stop strip portion 32 downwardly raised from a bottom side wall thereof between the elongated dents 31 for separating the conductors 41 and 51 of the electric wires 4 and 5 and limiting forward movement of the conductors 41 and 51 of the electric wires 4 and 5.

Furthermore, the metal retaining plate 2 and the metal contact plate 3 are shorter than the longitudinal length of the wire hole 11 of the cylindrical casing 1. After instilation of the electric wires 4 and 5 in the cylindrical casing 1, the insulator 42 of the first electric wire 4 and the insulator 52 of the second electric wire 5 are respectively and partially engaged into the wire hole 11 at a distance.

Figure 8:
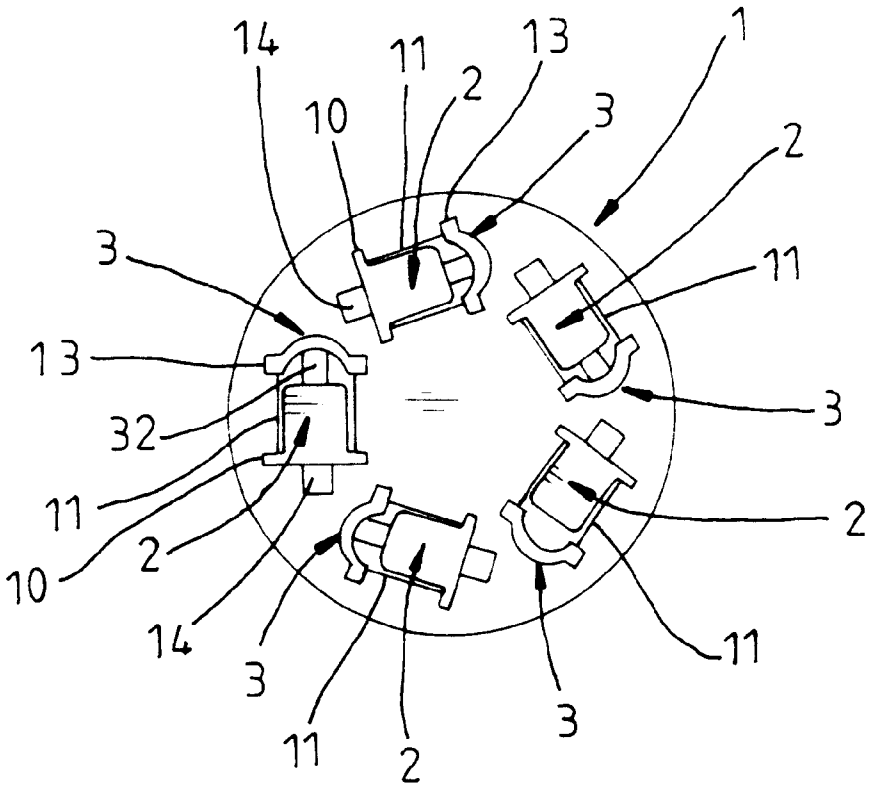
FIG. 8 is a front plain view of an alternate form of the present invention.

FIG. 8 shows an alternate form of the present invention, in which a plurality of wire holes 11 and provided through the two ends of the cylindrical casing 1 and arranged in parallel, and each wire hole 11 is installed with a respective metal retaining plate 2 and a respective metal contact plate 3. The alternate form is provided for connecting multiple pairs of electric wires.

What is claimed is:

1. An electric wire connector and electric wire arrangement comprising:

a cylindrical casing, said cylindrical casing comprising an axially extended wire hole, a first longitudinal positioning groove and a second longitudinal positioning groove disposed in said wire hole at bottom and top sides and axially extended to one end thereof;

a metal contact plate mounted in said second longitudinal positioning groove in said casing;

a first electric wire and a second electric wire respectively inserted into two opposite ends of the wire hole in said casing, said first electric wire and said second electric wire each having an insulator layer and conductor means extended out of said insulator layer and maintained in contact with said metal contact plate; and a metal retaining plate mounted in said first longitudinal positioning groove in said casing, said metal retaining Plate comprising a flat, elongated base portion mounted in said first longitudinal positioning groove in said casing, two retaining portions extended upwardly obliquely from two distal ends of said base portion and respectively Pressed on the conductor means of said first electric wire and said second electric wire against said metal contact plate.

2. The electric wire connector and electric wire arrangement of claim 1 wherein said casing further comprises a first stop edge at one end of said first longitudinal positioning groove which stops one end of said metal retaining plate, a second stop edge at one end of said second longitudinal positioning groove which stops one end of said metal contact plate, two locating grooves respectively and axially extended to the distal ends thereof in reversed directions and disposed in communication with said wire hole through said first longitudinal positioning groove, said locating grooves each having an inner end terminating in a respective stop edge; said metal retaining plate further comprises a hooked portion downwardly raised from said base portion and hooked on the stop edge at one end of one of said locating grooves, and two shoulder portions respectively connected between said base portion and said retaining portions, one of said shoulder portions being stopped at said first stop edge at one end of said first longitudinal positioning groove.

3. The electric wire connector and electric wire arrangement of claim 1, wherein said metal contact plate comprises two elongated dents of smoothly arched cross section longitudinally extended in reversed directions to two distal ends longitudinally extended positioning groove:

pairs of electric wires respectively mounted in cable holes, each pair of said pairs of electric wires including a first electric wire and second electric wire of each pair of said pairs of electric wires respectively inserted into two opposite ends of one wire hole in said casing, said first electric wire and said second electric wire each having an insulator layer and conductor means extended out of said insulator layer and maintained in contact with the metal contact plate in the corresponding wire hole; and a plurality of metal retaining plates respectively mounted in the first longitudinal positioning groove in each of said sets of longitudinally extended positioning grooves, said metal retaining plates each comprising a flat elongated base portion mounted in the respective first longitudinal positioning groove in said casing, two retaining portions extended upwardly obliquely from two distal ends of said base portion and respectively pressed on the conductor means of the respective first electric wire of each pair of said pairs of electric wires and the conductor means of the respective second wire of each pair of said pairs of electric wires against the metal plate in the second longitudinal positioning groove in the respective wire hole.

* * * * *